United States Patent [19]

Knapp et al.

[11] Patent Number: 4,951,045

[45] Date of Patent: Aug. 21, 1990

[54] PORTABLE ELECTRONIC WARNING DEVICE FOR TEMPORARY CONDITIONS

[75] Inventors: Floyd H. Knapp, Mountain View; Gregory C. Rogers, Sunnyvale, both of Calif.

[73] Assignee: Intelligent Safety Technology, Inc., Mountain View, Calif.

[21] Appl. No.: 330,068

[22] Filed: Mar. 29, 1989

[51] Int. Cl.[5] ..... G08G 1/095

[52] U.S. Cl. ..... 340/944; 340/691; 340/692; 340/573; 340/815.1; 340/525; 340/561; 40/550; 40/427

[58] Field of Search ..... 340/944, 692, 691, 700, 340/701, 789, 815.01, 909, 815.02, 815.1, 905, 815.11, 907, 911, 908, 573, 567, 326, 525, 561; 40/546, 550, 575, 581, 583, 444, 457, 427; 379/56, 57

[56] References Cited

U.S. PATENT DOCUMENTS

| | | | |
|---|---|---|---|
| 2,595,993 | 5/1952 | Templeman et al. | 179/100.3 |
| 3,459,961 | 8/1969 | Ravas | 307/116 |
| 3,560,950 | 2/1971 | Peters | 340/258 |
| 3,594,760 | 7/1971 | Haker | 340/325 |
| 3,648,235 | 3/1972 | Cahill | 340/944 |
| 3,662,371 | 5/1972 | Lee et al. | 340/258 R |
| 3,675,190 | 7/1972 | Auer, Jr. et al. | 340/1 |
| 3,760,399 | 9/1973 | Schwarz | 340/258 D |
| 3,771,123 | 11/1973 | Lanes | 340/104 |
| 4,179,691 | 12/1979 | Keller | 340/567 |
| 4,195,234 | 3/1980 | Berman | 307/117 |
| 4,344,071 | 8/1982 | Allen | 340/566 |
| 4,433,328 | 2/1984 | Saphir et al. | 340/555 |
| 4,551,654 | 11/1985 | Barnum | 315/159 |
| 4,660,024 | 4/1987 | McMaster | 340/522 |
| 4,661,720 | 4/1987 | Cameron, Jr. et al. | 307/117 |
| 4,709,330 | 11/1987 | Yokoi et al. | 340/573 |

OTHER PUBLICATIONS

"The Omen", Pedtracon Pedestrian Traffic Control, 2-21-90.

*Primary Examiner*—Donnie L. Crosland

*Attorney, Agent, or Firm*—Burns, Doane, Swecker & Mathis

[57] ABSTRACT

A portable electronic warning device for temporary conditions including a sensor to detect the presence of a pedestrian at a minimum first predetermined position, the sensor connected to circuitry which provides output to a plurality of focusing lights, preferably concentric bands of light, which direct the attention of the pedestrian to a message positioned concentrically within the lights, the device optionally including an audible alarm to simultaneously audibly alert a pedestrian.

11 Claims, 2 Drawing Sheets

PORTABLE ELECTRONIC WARNING DEVICE FOR TEMPORARY CONDITIONS

BACKGROUND OF THE INVENTION

The invention relates generally to warning devices used to inform a pedestrian of a temporary condition or hazard and specifically to an improved electronic device that is portable and can be used to inform a pedestrian of a wide variety of temporary conditions.

PRIOR ART

Heretofore, a variety of devices has been used to warn a pedestrian of a condition that may be dangerous. These devices may be generally classified as passive devices and differ only in their physical configurations. For example, plastic traffic or safety cones have long been used in an attempt to distinguish or block off access to areas where a specific condition exists. Some of these cones have wording printed on them or include the use of a small sign or flashing light on top of the cone.

Another type of known device is a sign forming or mounted to a saw horse-type frame having sets of A-frame legs. Visible from two sides, these devices are an improvement to the cones with regard to the size and variety of messages that may be displayed.

Another type of known device consists of separate pieces that may be linked together to form a barricade. These devices have limited or no printed wording and are clumsy and awkward to use.

Passive devices of the type described above are believed to have little or no impact on a pedestrian observing the devices since they possess little emotive value. The science of psychophysics teaches that associations are important and far-reaching in their effects upon our nervous system and that steady exposure to any single stimulus, especially from passive objects, tends to weaken the brain's response. Because currently used devices have become commonplace, they generally blend into the background or otherwise become non-noticeable. In addition, any single stimulus reaching the eye may be inadequate or ambiguous as far as conveying a message is concerned.

The eye notices only what it is concentrating upon at a given moment or any relatively large sudden change in its field of view. If a pedestrian is concentrating on something else and does not consciously see a currently used warning device, the pedestrian never becomes aware of the message being given, and the warning sign has no impact.

Commonly used devices are passive and rely upon ambient light in order to be seen. The reflected ambient light is referred to as secondary light and is at a lower level than the ambient light level. Psychological studies indicate that secondary light possesses only moderate emotive value and that in subdued lighting a passive device may not be noticed at all by a pedestrian.

Electronic devices which detect the relative motion of an observer and which use an independent light source for the purpose of alerting the observer have been developed.

U.S. Pat. No. 3,594,760 discloses an advertising display device and an alarm means responsive to the presence of a prospective customer. The unit is a pneumatically operated device intended to be used in fixed locations. The customer makes a manual selection of the choices offered. Thus, the unit is a sales device and is not applicable to warnings or informative messages. A lighted panel attracts the customer's attention, but only in the same manner as an exit sign attracts attention in a theater—not by forcing the eye to focus upon a central location.

U.S. Pat. No. 3,771,123 discloses an optical alerting device which flashes only when there is relative motion between the device and a sensor. The flashing rate of the device is a function of both the closing rate between the moving object and the device and the distance of the moving object from the device. The device uses a fanning pattern of alternating light- and-dark or colored light patterns. The concept of flashing is perceived when a moving object crosses the light pattern in a manner that is tangent to the focal point. The device "flashes" at a rate that is a function of the rate of movement and the angle of incidence. The "flashing" is an optical illusion and is not a real process or active function. There is no real similarity between this device and the subject invention. The subject invention responds to the approach of a pedestrian and is capable of giving a specific message; it does not function merely as an alerting device with no capability of emitting specific messages.

Another device recently marketed under the trade name "Omen" provides a portable electronic unit with interchangeable message plates. The "Omen" device has no actual attention-focusing capabilities; it functions merely by illuminating a transparent panel upon which a message is written. It relies upon flashing to attract the eye's attention. Unfortunately, one's attention is not drawn or focused to the device, and the device is capable of being set at only one level as opposed to the several settings of the subject invention. As such, the "Omen" is a vastly inferior device.

Even though these lastly-described devices are active versus passive and generate light, none of these devices discloses a portable electronic warning device for temporary conditions which both senses the presence of a pedestrian at a minimum predetermined position and in response thereto optically focuses the pedestrian's attention to a particular pertinent message. Specifically, none of the currently used warning devices actually causes the subconscious mind to force the conscious mind of the pedestrian to notice the specific warning intended.

SUMMARY OF THE INVENTION

The purpose of the invention is to provide a portable electronic warninq device for temporary conditions which causes a pedestrian to focus on an intended message or warning. To accomplish this purpose, there is provided a portable self-contained device consisting of an interchangeable illuminated main message sign surrounded by three or more illuminated and sequentially pulsed concentric colored bands and an optional spoken warning or message combined with an audible alarm. The visual and audible functions are activated by a user-adjustable motion detection system, which when triggered activates the illumination for the main message sign, flashes the colored bands in sequence, and activates the combination spoken warning or message/audible alarm function. All of these functions remain activated until the pedestrian moves out of the range of the sensor of the motion detection system.

In one aspect of the invention, there is provided a portable electronic warning device for temporary conditions comprising:

sensor means to detect the presence of a pedestrian at a minimum first distance from the device and to produce a signal in response thereto;

circuitry means connected to said sensor means to receive said signal from said sensor means and to produce an output; and alerting means connected to said circuitry means to receive said output and to visually alert a pedestrian to a message, said alerting means including a plurality of focusing lights and an interchangeable message positioned adjacent said lights, said lights directing the pedestrian's attention to the message.

DESCRIPTION OF THE PREFERRED EMBODIMENT

It is highly desirable to provide an electronic warning device that is portable and self-contained and which offers the broadest range and has the highest degree of functional and emotive value, versatility and reliability, thereby inducing a conscious response from a pedestrian and allowing the pedestrian to make an informed and intelligent decision about what action should be taken regarding a specific condition or hazard.

Figure 1:
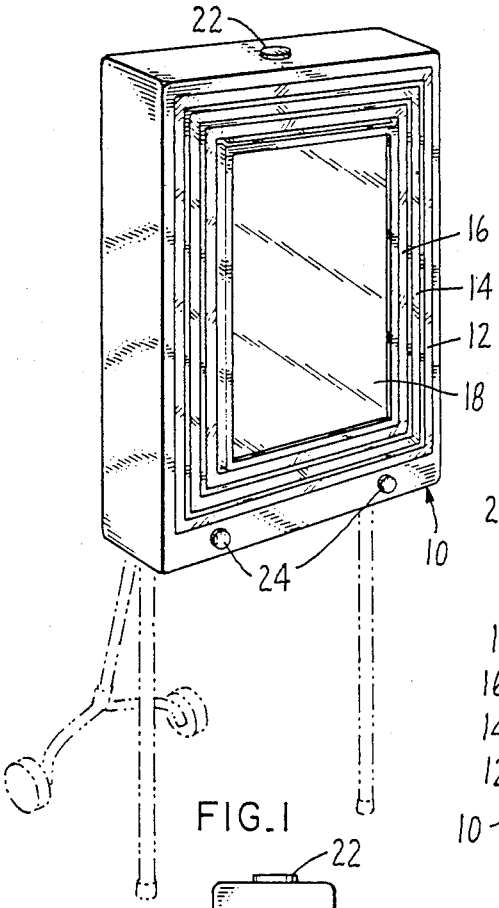
FIG. 1 is a perspective view of the portable electronic warning device with supports (shown in phantom)
Figure 3:
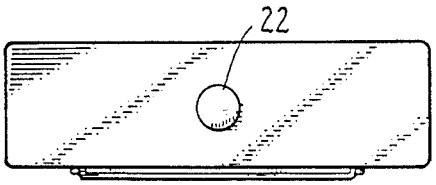
FIG. 3 is a top view of the device of FIGS. 1 and 2.

Scientific studies tell us that individual nerve fibers never act independently in the field of vision. In fact, there is interaction among various nerve fibers; therefore, visual function must be thought of in terms of the integrated action of all units of the visual system. Specifically, there are three nerves of concern. The first responds when a light is turned on, the second when a light is turned off, and the third is a combination of the first two. As seen in FIG. 1, the device shown generally at 10 of this invention takes full advantage of all these facts by continually stimulating these nervous subsystems via three bands 12, 14 and 16 of lights which surround the main message plate 18. Each band of lights flashes in succession, starting with the outermost band 12. After the sequence has progressed to the innermost band 16, the sequence is repeated.

The message plate 18 centered in the above-stated bands is back lit by sign illumination 20. The illumination of the main message plate 18 and of the concentric bands of lights 12, 14 and 16 is by means of a primary light source. Such a primary light source has been proven to be more powerful and versatile than secondary, reflected ambient light and produces a greater emotive response.

Additionally, of all the elements which appeal through visual impression, the element of color is generally the most versatile and powerful. This invention incorporates the use of yellow, orange and red illuminated cover strips which comprise these three perimeter bands of lights 12, 14 and 16, respectively. Preferably, band 12 is yellow, 14 is orange and 16 is red. These colors have been found to be exciting or stimulating and tend to increase blood pressure, pulse rate and respiration. Also, these colors produce greater skin response and brain activity, thus causing attention to be directed to the immediate environment.

The outer band is yellow, the color to which the eye is most responsive. The inner band is red. Even though one is not as responsive to red as one is to yellow, the color yellow denotes danger or warning. The middle band is orange. Orange is chosen as being the color midway between the most responsive color (yellow) and the color associated with danger (red). By cycling from the outermost band to the innermost band the pedestrian's attention is focused toward the center of the bands, and the cycling from the most responsive color to the warning color conveys an alerting message.

In the field of hearing or audio response, we know that sound informs each individual as to his placement in his world. Sound can add information to stimuli received by the eyes and other sensory organs, or sound may present the first clues about a new event. Because sound (or noise) at the basic level of awareness is interpreted as a warning of danger and stimulates our emotions, a sonic device which emits an intermittent tone has been incorporated in this invention by the presence of what is generally referred to as audible alarm/voice transducer 22. Thus, once this audible tone is activated, it stimulates a response and calls attention in its direction, bringing a pedestrian's attention to the message being given, even though the pedestrian may not have been looking in the direction of the device while approaching it. A spoken warning or message is important since the visually impaired pedestrian could have a problem reading an illuminated message. An optional speech synthesizer, which is within the scope of the audible alarm/voice transducer 22, allows the combination of an alarming sound with a spoken warning or message for further enhancement of the warning.

In contrast, in the "Omen" device described earlier, there is no actual optical focusing pattern. The subject invention utilizes an optical focusing pattern. The "Omen" has only one setting level and cannot be set to increase the urgency level of the warning or message. The subject invention also incorporates a dual voice system that allows the user to either record a message using his own voice or to make use of the built-in speech synthesizer to generate a spoken warning or message with the required vocal characteristics for demanding attention and obedience. (Some people's voice characteristics give them more "presence" or "authority" than others, and a speech synthesizer can mimic these and other voice characteristics.)

Activation of all of the above-stated functions is achieved via built-in motion detection system 24. This system allows the functions of the invention to remain in standby mode until it senses, at a user-adjustable distance, the approach of a pedestrian. Once activated, all functions of the device remain active until the pedestrian has moved out of range of the motion detection system 24. This arrangement is designed to stimulate abrupt and then continuing activity of the pedestrian's senses. It also conserves power which is supplied by either the on-board rechargeable battery or a standard electrical outlet.

Finally, the device employs response feedback. Feedback from the pedestrian causes various levels of response on behalf of the device as the pedestrian approaches the device. At the initial trip point of motion detection system 24, the flash rate is slow, the sign illumination intensity is low, the audible alarm rate is slow, and the first spoken warning is given. As the pedestrian approaches the device, the flash rate increases, the sign illumination intensity increases, the rate of the audible alarm increases, and the spoken message changes.

In contrast, the perceived flashing observed in a device based upon U.S. Pat. No. 3,771,123 relies upon the relative movement between the observer and the device and is a function of speed, distance and closing angle. The rate of the perceived flashing increases with the increased speed of the observer. Thus, the device does not give the same level of stimulus to persons traveling at different rates of speed. When a person is closer to this device, the width of the bands is shorter, thus demonstrating greater importance as one draws closer. If the closing angle is zero degrees (0°) (the person is situated directly at the point of origin), there will be no perceived flashing because the person will not leave any particular zone of the fan-shaped pattern. As the approach angle becomes more oblique, the flash rate will increase, other factors remaining the same. This is not very effective, nor is it desired.

Extreme versatility of this invention is further assured via an interchangeable message plate and track system. This allows the user to make use of a virtually unlimited number of prepared messages in any language or format and provides the user with means to impart the correct message for any given situation. The compact, integrated construction allows for easy handling and storage.

Scientific studies tell us that any single stimulus may be inadequate to serve as a warning stimulus, but that the interaction of a great many stimuli is a powerful means of imparting a warning. Appropriately, this invention demands a conscious response or awareness from a pedestrian because the brain has been activated through carefully planned and controlled stimuli.

As discussed above, FIG. 1 is a perspective view of one of the possible physical packages of the preferred embodiment. This contains audible alarm/voice transducer 22, motion detection system 24, and message plate 18 showing the desired spoken warning or message in printed/painted form, on but not limited to translucent material. Message plate 18 is changeable, thus allowing different messages and adding to the device's versatility. Means using but not limited to different colored bands of lights 12, 14 and 16 arranged in concentric, converging patterns optically focus attention on message plate 18. Sign illumination 20, usually but not limited to incandescent lights, illuminates the translucent sign material of message plate 18 and is located behind message plate 18. Some embodiments may combine both sign illumination 20 and message plate 18 as one unit as in, but not being limited to, an LCD display, a CRT screen, or any other display or projection system or device.

Figure 6:
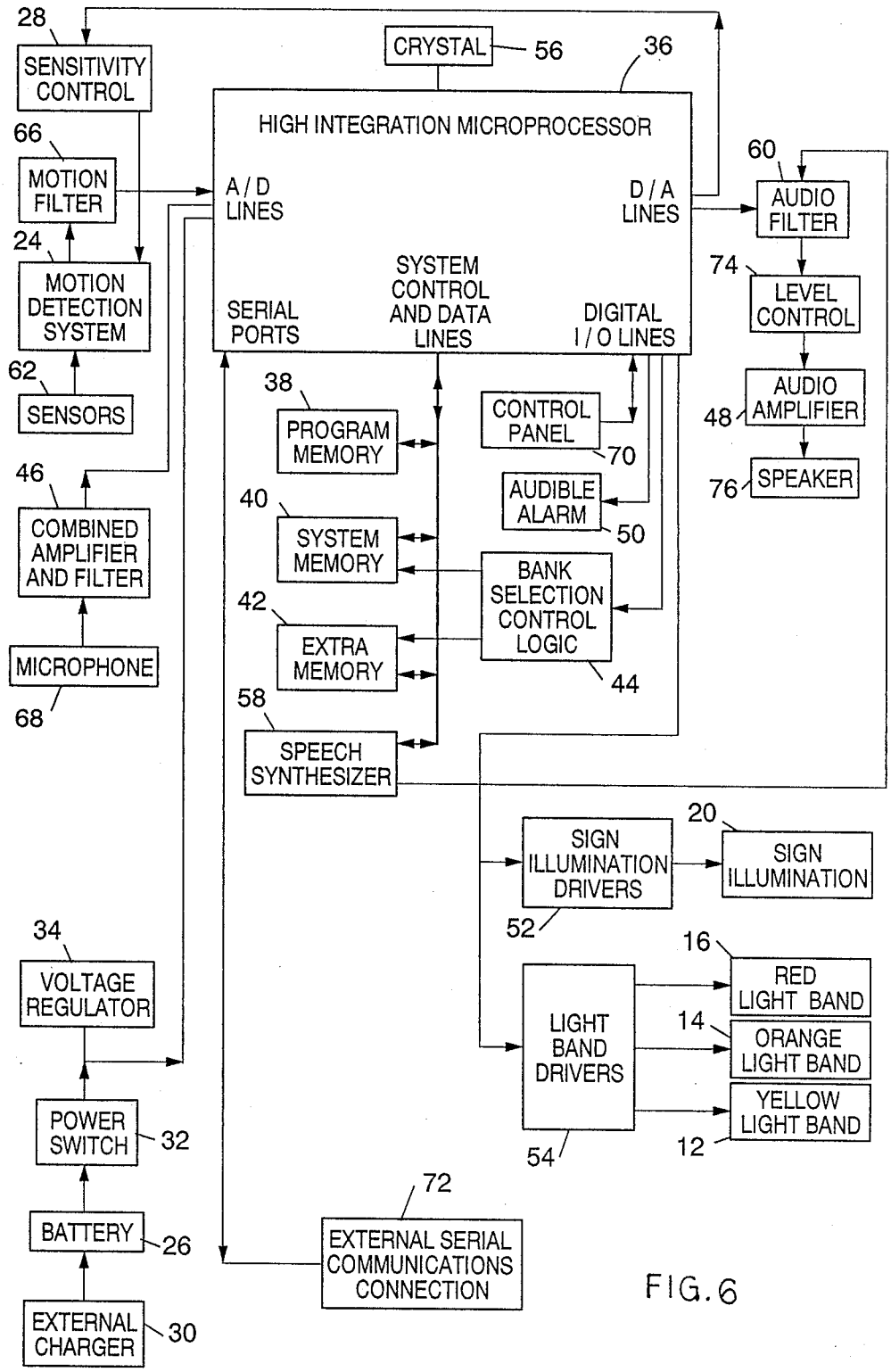
FIG. 6 is a block diagram of the electronic and electrical subsystems that comprise the invention.

FIG. 6 shows the electrical and electronic systems of the preferred embodiment. Power to the device is supplied by battery 26. The device also provides means for connection to external charger 30 and further provides power switch 32 which removes power from the whole device. An external power source (not shown) may be plugged into the external charger 30, thus allowing battery 26 to be disconnected for long-term use of the device. Voltage regulator 34 supplies power to high integration microprocessor 36, program memory 38, system memory 40, extra memory 42, bank selection control logic 44, combined amplifier and filter 46, and parts of motion detection system 24. Audio amplifier 48, audible alarm 50 (part of audible alarm/voice transducer 22), sign illumination drivers 52, and light band drivers 54 are supplied with power directly from battery 26.

High integration microprocessor 36 uses crystal 56 as the source for all time measurements using built-in counters and firmware contained in program memory 38 to provide all timing of pauses, durations and sampling intervals. Program memory 38 contains the firmware for all functions and features of this device. System memory 40 and extra memory 42 are random access memories for external storage of variables and recorded messages for playback through optional speech synthesizer 58 (another preferred part of audible alarm/voice transducer 22) or direct output into audio filter 60. Bank selection control logic 44 is used to switch between system memory 40 and extra memory 42, thus allowing greater than 64K byte of random access memory.

The address, data and control lines of high integration microprocessor 36 are connected to program memory 38, system memory 40, extra memory 42, speech synthesizer 58, and bank selection control logic 44; they are connected together in the manner of a normal microprocessor system.

Sensors 62 with motion detection system 24 combine to form the motion detection subsystem. The subsystem detects a moving person or object within the motion detection area. Sensitivity control 64 is used to limit the size of the motion detection area. Motion filter 66 removes spurious responses from the motion detection subsystem, and its output is connected to one of the analog-to-digital conversion input pins of high integration microprocessor 36. The input of sensitivity control 64 is connected to a digital-to-analog output pin of high integration microprocessor 36, thus allowing the firmware to reduce the sensitivity of motion detection system 24. This allows a measurement of increasing proximity of the person or object entering the motion detection area, thus allowing many levels of signals as the person or object draws closer.

Microphone 68 is connected to combined amplifier and filter 46 which is in turn connected to another analog-to-digital input pin of high integration microprocessor 36. By using digital sampling an electronic recording can be made for later playback. The response of combined amplifier and filter 46 and control of the digital sampling rate of high integration microprocessor 36 limits the output of the voice band to between 300 and 3200 Hz.

Control panel 70 is used to switch between standby and operational modes, to select recorded or synthesized speech, to select speech or alarm or neither, to disable sign illumination 20, to disable light band drivers 54, or to allow down loading of synthesized speech through external serial communications connection 72. Firmware reads these digital input-output lines and reacts accordingly. Audible alarm 50 is controlled by a digital input-output line from high integration microprocessor 36. Sign illumination drivers 52 and light band drivers 54 are controlled by digital input-output lines from high integration microprocessor 36.

Audio filter 60 has two inputs. One is the audio output from speech synthesizer 58, and the other is a digital-to-analog output from high integration microprocessor 36. Audio filter 60 aids in the reconstruction of speech by removing the sharp steps in the signal voltage produced by speech synthesizer 58 or the digital-to-analog output from high integration microprocessor 36. Level control 74 establishes the maximum sound level generated. Audio amplifier 48 amplifies the small signal voltage from level control 74 and provides the power to drive speaker 76.

External serial communications connector 72 provides the connection between the serial port in high integration microprocessor 36 and an external computer for transferring speech synthesis data arrays for playback of warning or other types of messages.

Sign illumination drivers 52 allow high integration microprocessor 36 to control the intensity of sign illumination 20, giving at least three levels of visibility. Light band drivers 54 turn on the yellow band of lights 12, orange band of lights 14 and red band of lights 16 in response to commands on the digital input-output lines from high integration microprocessor 36.

The operating sequences are described as follows. When the power is turned on, high integration microprocessor 36 performs a self-check of program memory 38, checks out and initializes system memory 40 and extra memory 42, initializes sign illumination drivers 52 and light band drivers 54 to the standby mode, checks operation of motion detection system 24, initializes speech synthesizer 58, and examines control panel 70 to ascertain the type of function to be performed. At this time the unit can be operational or in the standby mode.

If in the standby mode, up to three messages may be stored. These stored messages may be of either recorded voice or down loaded speech synthesis via external serial communications connector 72. The voltage of battery 26 is constantly monitored, and light-emitting diodes on control panel 70 display the charge level. Green is displayed for a high level of charge, yellow for low, and both light-emitting diodes go out if the charge of battery 26 is too low.

In normal operation the unit monitors the signal level from the output of motion filter 66 and does not activate until the trip point stored in the firmware is exceeded. Once tripped, the system will maintain the signal voltage from motion filter 66 between the trip level and a maximum level by adjusting the sensitivity of motion detection system 24—with a digital-to-analog signal line through sensitivity control 28, thus forming an automatic gain control loop. The amount of gain reduction is monitored, providing several additional trip points for additional actions to be performed.

Upon detection by the firmware of a person entering the motion detection area, the unit activates the proper sign illumination driver 52, and starts the cycle of yellow 12, orange 14 and red 16 bands of lights. Audible alarm 50 is activated briefly, and then the proper spoken warning in the form of a synthesized message or a prerecorded message is transmitted by high integration microprocessor 36 via a digital-to-analog channel. This signal is filtered by audio filter 60, attenuated properly by level control 74 and then raised in power level by audio amplifier 48 and transferred to acoustic waves by speaker 76.

The first detection point causes bands of lights 12, 14 and 16 to cycle at a slow rate, minimum illumination to be provided by sign illumination 20, and the first audible message to be played. Each additional trip point causes the cycle rate of bands of lights 12, 14 and 16 to increase, sign illumination 20 to increase, and the next audible message to be played. Generally, only three levels are used, but it is within the scope of the invention for more to be used. The only limitations to the number of levels are the size of extra memory 42 and the levels of which sign illumination drivers 52 are capable. A switch on control panel 70 selects the number of detection levels employed at any one time.

Once activated by triggering the trip point, the unit will stay operational until all persons leave the motion detection area and for three seconds afterward. Then it will return to standby mode until it is triggered again.

It is apparent that the described hardware configuration is somewhat arbitrary and that high integration microprocessor 36 of the microprocessor unit replaces external devices, thus allowing for more compact design and construction. Circuitry redesign to employ different devices provides the same function due to economic factors but does not change the actual system operation. Neither detail of the microprocessor design and operation nor the actual details of any particular circuit are covered here because those details and construction thereof are known to anyone skilled in the art.

Figure 2:
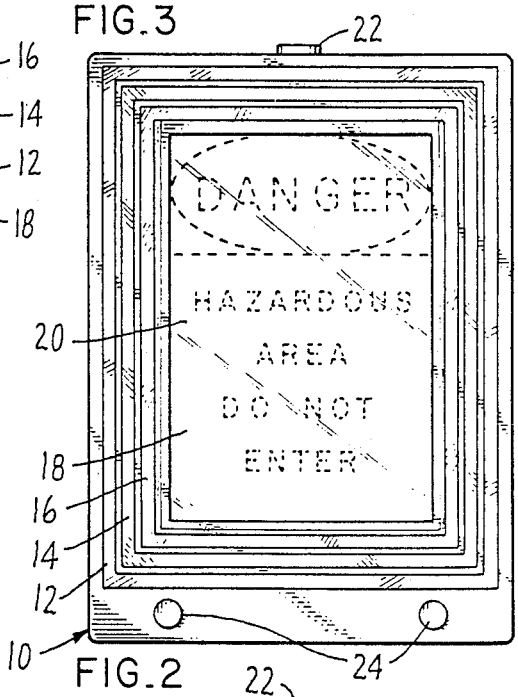
FIG. 2 is a front view of the device of FIG. 1 with a particular message (shown in phantom) in place.
Figure 4:
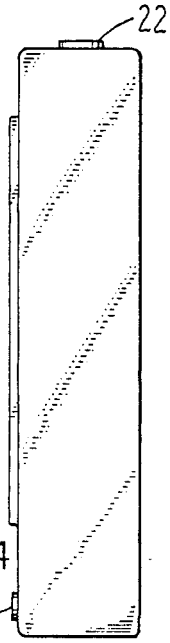
FIG. 4 is a side view of the device shown in FIGS. 1–3.
Figure 5:
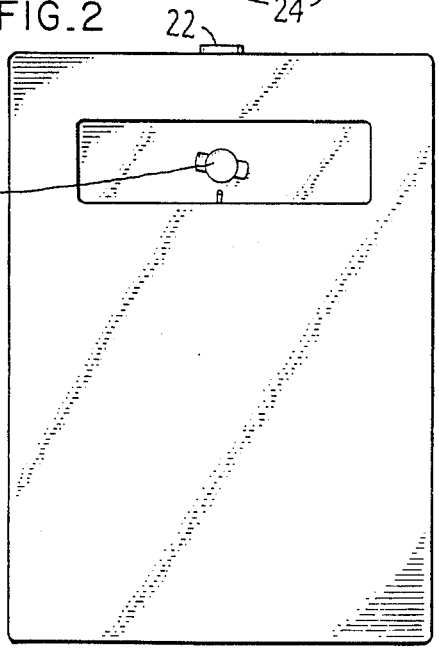
FIG. 5 is a back view of the device shown in FIGS. 1–4.

FIG. 2 illustrates concentric bands of lights 12, 14 and 16 arranged concentrically around message plate 18. The said concentric bands of lights 12, 14 and 16 are composed of translucent colored material. The color pattern shown is, but is not limited to, yellow, 12; orange, 14; and red, 16. The number of said concentric bands of lights may be more or fewer, depending upon the degree of effectiveness desired. The lighting of said concentric bands of lights is provided by sign illumination 20 which is usually miniature incandescent bulbs although light-emitting diodes, electro-luminescent strips or other means may be used. In order to focus awareness on message plate 18, the concentric bands of lights 12, 14 and 16 are illuminated in order, starting with the outermost band 12 and finishing with the innermost band 16. Illuminating the outermost band first, extinguishing it before illuminating the next innermost band, continuing this pattern to the innermost band and then repeating the entire cycle creates the illusion of motion. By using consecutively smaller bands of lights the illusion of motion serves to draw the attention of the pedestrian to the center where message plate 18 is located. If the flash function is activated for message plate 18, the flash function is the last active step of the sequence; otherwise, the flash function is operational while the device is activated.

Thus, the reader will see that the warning sign generated by the above invention is blatant in advertising its presence and forces recognition of its message. This is a true advance in the art of pedestrian warning signs.

In all cases where specific circuitry is mentioned, the choice of said circuitry is not a limit on the claims or descriptions but is only a means of identifying a function or action needed. All of the functions of the control and timing circuits can be duplicated by a processor-based system.

It will be obvious to those skilled in the art having regard to this disclosure that other variations of this invention beyond those specifically exemplified here may be made. Such variations are, however, to be considered as coming within the scope of this invention and are limited solely by the following claims.

What is claimed is:

1. A portable electronic warning device for temporary conditions comprising:

sensor means to detect the presence of a pedestrian at a minimum first distance from the device and to produce a signal in response thereto;

circuitry means connected to said sensor means to receive said signal from said sensor means and to produce an output; and alerting means connected to said circuitry means to receive said output and to visually alert a pedestrian to a message, said alerting means including a plurality of focusing lights and an interchangeable message positioned adjacent said lights, said focusing lights comprising concentric bands of lights which are illuminated sequentially inwardly, focusing a pedestrian's attention to the message positioned within said concentric bands of lights.

2. A device as in claim 1 wherein there are three bands of lights, the outermost being yellow, the innermost being red and the ring in between being orange.

3. A device as in claim 2 further including an audible alarm connected to said circuitry means to alert a pedestrian concurrent with the illumination of said bands of lights.

4. A device as in claim 3 wherein said audible alarm comprises a pre-recorded message.

5. A device as in claim 3 wherein said audible alarm comprises a speech synthesized message.

6. A portable electronic warning device for temporary conditions comprising:

sensor means to detect the presence of a pedestrian at a minimum first distance from the device and to produce a signal in response thereto, said sensor means also detecting a pedestrian at a second distance closer than said minimum first distance position;

circuitry means connected to said sensor means to receive said signal from said sensor means and to produce an output; and alerting means connected to said circuitry means to receive said output and to visually alert a pedestrian to a message, said alerting means including a plurality of focusing lights and an interchangeable message positioned adjacent said lights, said lights directing the pedestrian's attention to the message, said circuitry means enhancing the output to said alerting means when said sensor means is detecting a pedestrian at a second distance closer than said minimum first distance position.

7. A device as in claim 6 wherein the enhancement of the alerting means includes an increase in speed of the sequencing of the focusing lights.

8. A device as in claim 6 wherein the enhancement comprises the intensification of the illumination of the focusing lights.

9. A device as in claim 6 further including an audible alarm connected to said circuitry means to alert a pedestrian concurrent with the illumination of the focusing lights.

10. A device as in claim 9 wherein said audible alarm comprises a pre-recorded message wherein said enhancement comprises switching to a different message.

11. A device as in claim 9 wherein said audible alarm comprises a synthesized message wherein said enhancement comprises switching to a different synthesized message.

* * * * *